United States Patent [19]

Iijima

[11] 4,040,340

[45] Aug. 9, 1977

[54] AUTOMATIC PASTE BOARD BOX FORMING MACHINE

[76] Inventor: Tomeo Iijima, 3-1363, Kamiaoki, Kawaguchi, Saitama, Japan

[21] Appl. No.: 694,230

[22] Filed: June 9, 1976

[30] Foreign Application Priority Data

June 9, 1975 · Japan ..... 50-68628

[51] Int. Cl.[2] ..... B31B 3/26

[52] U.S. Cl. ..... 93/49 R; 93/36 R

[58] Field of Search ..... 93/49 R, 51 R, 51 HW, 93/45, 41, 36 R; 74/501.5 R, 503, 501 R

[56] References Cited

U.S. PATENT DOCUMENTS

| | | | |
|---|---|---|---|
| 1,867,259 | 7/1932 | Goss | 93/49 AC |
| 2,887,022 | 5/1959 | Lubersky et al. | 93/49 R |
| 3,101,653 | 8/1963 | Burden | 93/49 R |
| 3,343,464 | 9/1967 | Gross | 93/36 R |
| 3,448,633 | 6/1969 | Jackoboice | 74/501.5 |

FOREIGN PATENT DOCUMENTS

| | | | |
|---|---|---|---|
| 914,287 | 1/1963 | United Kingdom | 93/36 R |

*Primary Examiner*—James F. Coan

[57] ABSTRACT

An automatic paste board box forming machine comprises a paste board box forming mechanism bending a paste board and assembling a paste board box, a paste board supplying mechanism feeding a paste board piece by piece to the forming mechanism, and a driving part of both mechanisms, a driving force generating mechanism, by which driving force necessary to bend a paste board and assemble a paste board box in the paste board box forming mechanism is generated by said driving part, an end of a steel wire slidably inserted in a hollow and shelled cable and connected to the driving force generating mechanism.

The other end of the steel wire is connected to a member used for assembling a paste board box in the paste board box forming mechanism, and a shock absorbing member is provided on the connecting portion of the steel wire with the member or with a driving force generating mechanism, so that an automatic paste board box forming machine is of simple construction and providing for high speed operation can be obtained at a low cost.

8 Claims, 10 Drawing Figures

AUTOMATIC PASTE BOARD BOX FORMING MACHINE

BACKGROUND OF THE INVENTION

This invention relates to an automatic paste board box forming machine by which a developed paste board is bent in order and a paste board box is assembled, espacially to an automatic paste board box forming mechine in which various type of operator used for paste board assembling is operated by cam through wire slidably inserted in a hollow and shelled cable, by which a driving force transmitting mechanism of each operator is simplified.

In the prior art, the paste board box forming mechine which forms paste board box storing cloths, food, etc. comprised assembling of link mechanism, gear mechanism, etc., where a driving force of an electric motor is transmitted to each operator. If the paste board box having various sizes is assembled with a single box forming machine, operators bending each side of box must be exchanged and a power transmitting mechanism should be greatly changed. In the case of the box forming machine having such exchanged mechanism, a construction of the box forming machine becomes complex to resulting in many troubles in addition to the high cost of the machine.

In the case of a power transmittitng mechanism having a combination of a link mechanism and a gear mechanism, if two or more paste board are fed to a paper bending mechanism, an abnormal excess load is imposed on the power transmitting mechanism by bending a paste board with operators, and a link mechanism which is a weak point in the construction in a power transmitting mechanism is destroyed. For a purpose of preventing this destruction, in the prior art, a sear pin is provided, which is sheared when a transmitting stress over constant value caused at the rotational parts of the power transmitting mechanism, so that destruction of a transmitting mechanism is prevented. However, the sear pin does not always suitably operate. For example, if a weak sear pin is used, even in a light load, the sear pin is often sheared during a normal paper box bending process. If a strong sear pin is used, the power transmitting mechanism is in danger of destruction before the shear pin is sheared.

Also, in prior paste board box forming machine, there are a types of the paste board box forming machine in which air pressure machine such as air cylinder is used to make the operator to work. In the type of the paste board box forming machine, a complex process, which is not able to conduct with a transmitting mechanism comprising the gear mechanism, can be carried out with a simple link mechanism connecting an air cylinder and an operator and with an air supplying hose connecting a cylinder and a compressor in addition to with an air cylinder.

However, in case of use of an air pressure mechanism, at first, the energy loss is large and the capacity of electric motor driving an air pressure mechanism must be large because mechanical energy is changed to compressed air pressure and still more to mechanical energy. In the second place, a jet sound is generated between a compressor and an air pressure storing tank and between latter tank and an air cylinder when compressed air is supplied into or exhausted from these mechansims. This phenomenon causes noise pollution. Also, a going-and-returning-response operation of air cylinder is restricted in the capacity and the construction of magnet valve by which compressed air is switched to air cylinder, so that the paste board box cannot be formed with high speed.

SUMMARY OF THE INVENTION

The main object of this invention is to provide an automatic paste board box forming machine in which a power transmittance used to assemble a paste board box is conducted with steel wire slidably inserted into a hollow and shelled cable, whereby a power transmittance mechanism due to operators is simplified and a box is easily formed with single steel wire in spite of the size of the box.

Another object of this invention is to provide an automatic paste board box forming machine in which an input driving force is correctly and speedily transmitted to the operator by the connection of driving force generating part with steel wires.

A further object of this invention is to provide an automatic paste board box forming machine in which the steel wire and the driving force generating parts are connected by a shock absorbing member, whereby an abnormal stress added to steel wires and a change of sliding amount of the steel wire accompanying with meandering movement of steel wire in the hollow and shelled cable can be absorbed.

A still further object of this invention is to provide an automatic paste board box forming machine in which a trouble detecting mechanism is provided either on the driving force input or output sides of steel wires to prevent steel wires from excess load stress.

A still further another object of this invention is to provide an automatic paste board box forming machine in which the driving force generating mechanism can be made intensive in one place to make the construction of this machine simple.

BRIEF DESCRIPTION OF THE DRAWING

The invention is described in detail to clear the other objects and features of this invention below with reference to the accompanying drawings.

DESCRIPTION OF THE PREFERRED EMBODIMENT

Figure 1:
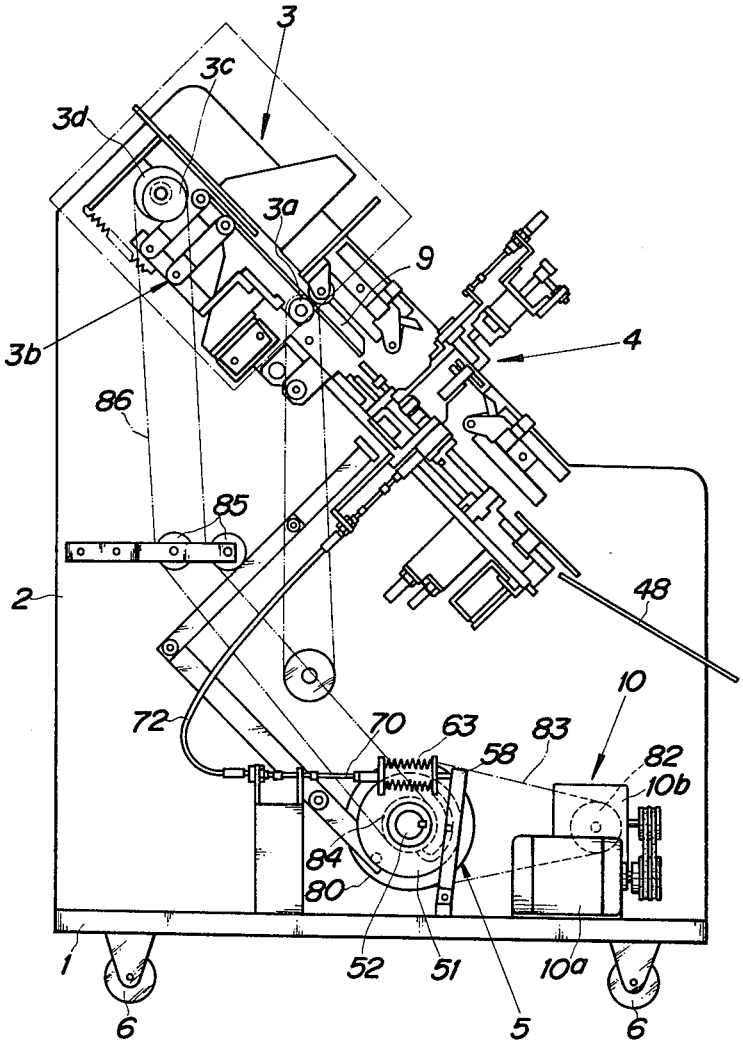
FIG. 1 is a side view indicating an outline of an automatic paste board box forming machine of this invention.
Figure 2:
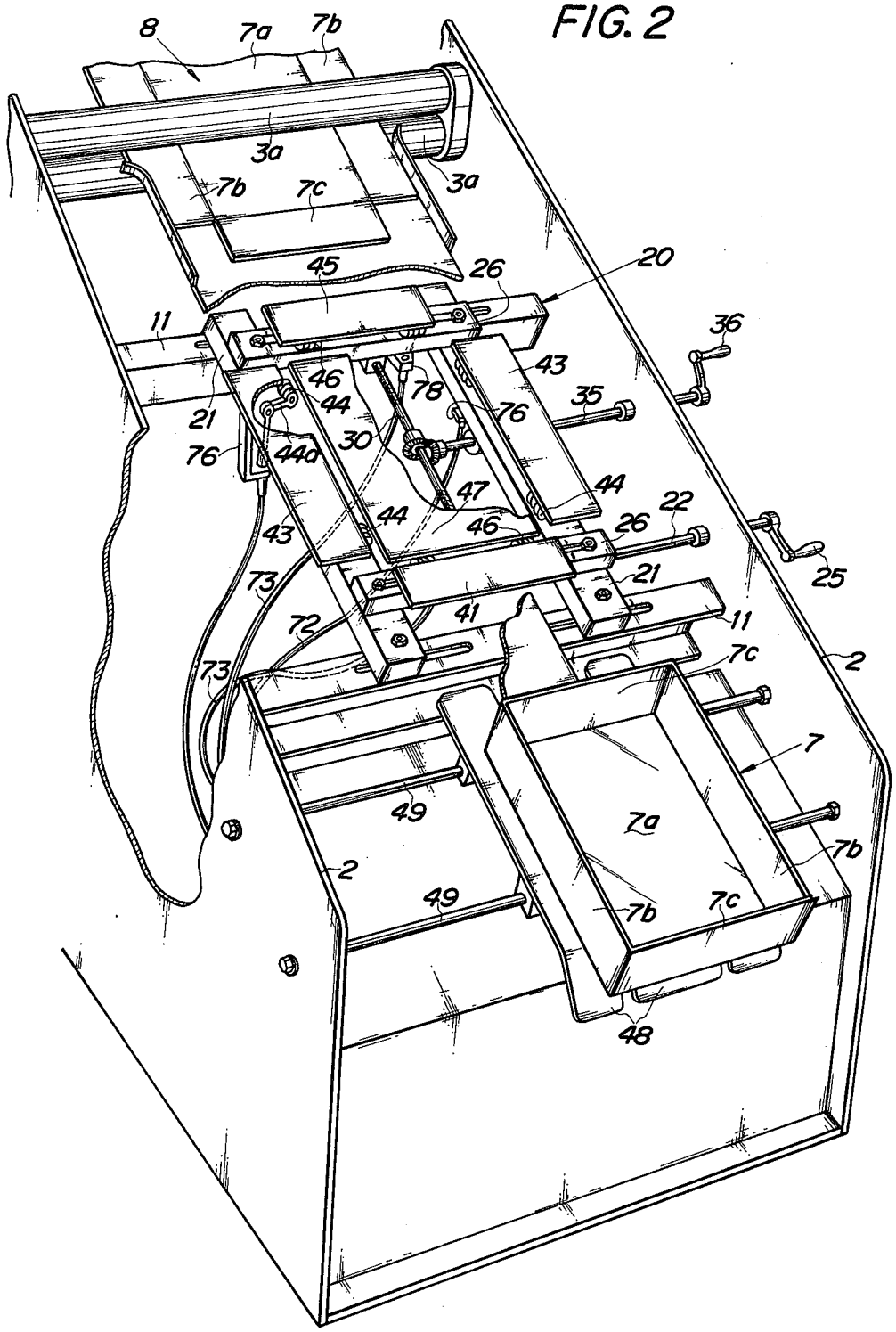
FIG. 2 is an outside view of an automatic paste board box forming machine in which a paste board box forming mechanism of FIG. 1 is indicated as a central portion.

Referring to the FIG. 1 and 2, a caster 6 is mounted on the under surface of the base plate 1, whereby a body of box forming machine is transfered free. At both right and left sides of the base plate, frame 2, 2 are vertically secured and upper edges of these frame 2, 2 are inclined downwardly to the direction of an assembled paste board box. At the top of the frames 2, 2, a paste board supplying mechanism 3 which is provided with feeding roll 3*a*, 3*a* supplying intermittently a developed paste board 8 piece by piece is provided parallel to a inclination of the upper edges of the frame. Between frame 2 and 2, facing to the side to which the paste board is fed, the paste board box forming mechanism 4 which bends the paste board 8 to form the paste board box 7 is provided with the same inclination as that of the upper edges of frame. Between the paste board supplying mechanism 3 and the paste board box forming mechanism 4, a guide plate 9 is mounted across them, through which the paste board 8 fed by roll 3*a*, 3*a* is guided to the paste board box forming mechanism 4. Also, on the base plate 1, there is provided with a driving means 10 comprising a cam mechanism 5 supplying a bending force of the paste board to each operators used to assemble a paste board box in the paste board box forming mechanism 4, with an electric motor 10*a* and a final reduction gear 10*b*. A going and returning movement produced by rotation of a cam in the cam mechanism 5 is transfered to the operators of the paste board box forming mechanism 4 through the steel wire inserted in the hollow and shelled cable. Therefore, the mechanism by which driving forces are transfered to the operators becomes remarkably simple as compared with the mechanism in the case of using prior links and gears.

Figure 3:
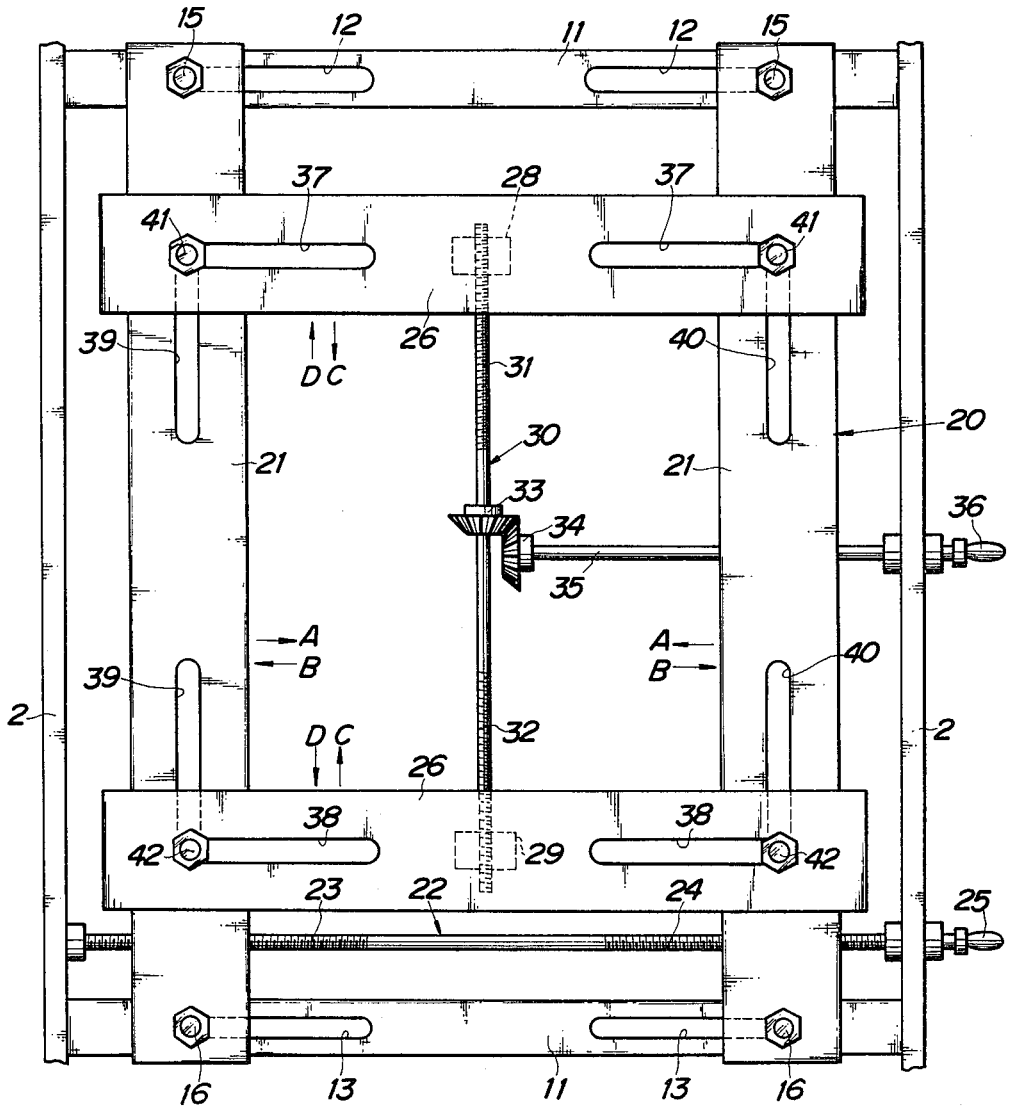
FIG. 3 is a plane view of a size changeable mechanism.

FIG. 3 indicates an assembly mechanism adjustable in accordance with the size of a paste board box and constructing main portion of the paste board box forming mechanism 4. As indicated in FIG. 2, this assembly is provided with two longitudinal members 21, 21 across channel member 11, 11 which are fixed on the frame 2, 2.

Thread portions 23, 24 of a screw bolt 22 penetrating vertically the longitudinal members 21, 21 are engaged with the longitudinal members 21, 21 and advance reverse direction to each other. Both ends of the screw bolt 22 are maintained by the frame 2, 2 in a rotatable condition. On the projecting end of the screw bolt 22 from the frame 2, a hand operable handle 25 is applied. By rotating right or left, this handle 25 revolves a screw bolt 22, the longitudinal member 21, 21 are moved to the direction of arrow A, where the longitudinal member 21, 21 close in the distance to each other, and to the direction of arrow B, where they are separated in the distance to each other.

Each end of the longitudinal member 21, 21 is settled to channel member 11, 11. with bolt nut 15 and 16 in long hole 12, 13 formed on the channel members 11, 11. Between the longitudinal members 21, 21, cross members 26, 26 are mounted vertically relative to the longitudinal members 21, 21.

At the center of the under surface of cross member 26, 26, nuts 28, 29 are fixed, with which screw portions 31, 32 having reverse advances to each other are engaged.

In the middle portion of the screw bolt 30, a bevel gear 33 is secured, with which another bevel gear 34 of which shaft 35 projects outwardly from the frame 2 is engaged. At the end of this shaft 35, a hand operable handle 36 can be rotated right or left, whereby the cross member 26, 26 are shifted to the direction of arrow C, where they close towards each other in the distance, and to the direction of arrow D, where they are separated from each other in the distance.

Both ends of cross members 26, 26 are tightened to the longitudinal members 21, 21 with bolt nut 41 and 42 to settle them through long holes 37, 37 and 38, 38 formed on the cross members and through long holes 39, 39 and 40, 40 formed on the longitudinal member.

On the upper part of the longitudinal members 21, 21 which is adjusted in accordance with a size of a bottom portion 7*a* of a paste board box 7, edge portions of the paste-board-bending-operator 43, 43 used for bending side portions 7*b*, 7*b* of the paste board 7 are pivotally mounted with hinge member 44, 44. Furthermore, on the surface of the cross member 26, 26, the paste board bending operator 45, 45 used for bending front and end portions 7*c*, 7*c* of the paste board 7 are pivotally mounted with hinge member 46, 46.

A plate 47 covers the part surrounded by the longitudinal members 21, 21 and the cross member 26, 26 and it also serves as an assembling plate of the paste board box 7.

Near the paste board box forming mechanism 4, at a paste board-feeding-out-side, a guide plate 48 is mounted on supporting rod 49, 49 fixed between the frames 2, 2 with a inclination parallel to the frames. This guide plate 48 is used to discharge outside the paste board box 7 assembled in the paste board box forming mechanism 4.

Figure 4:
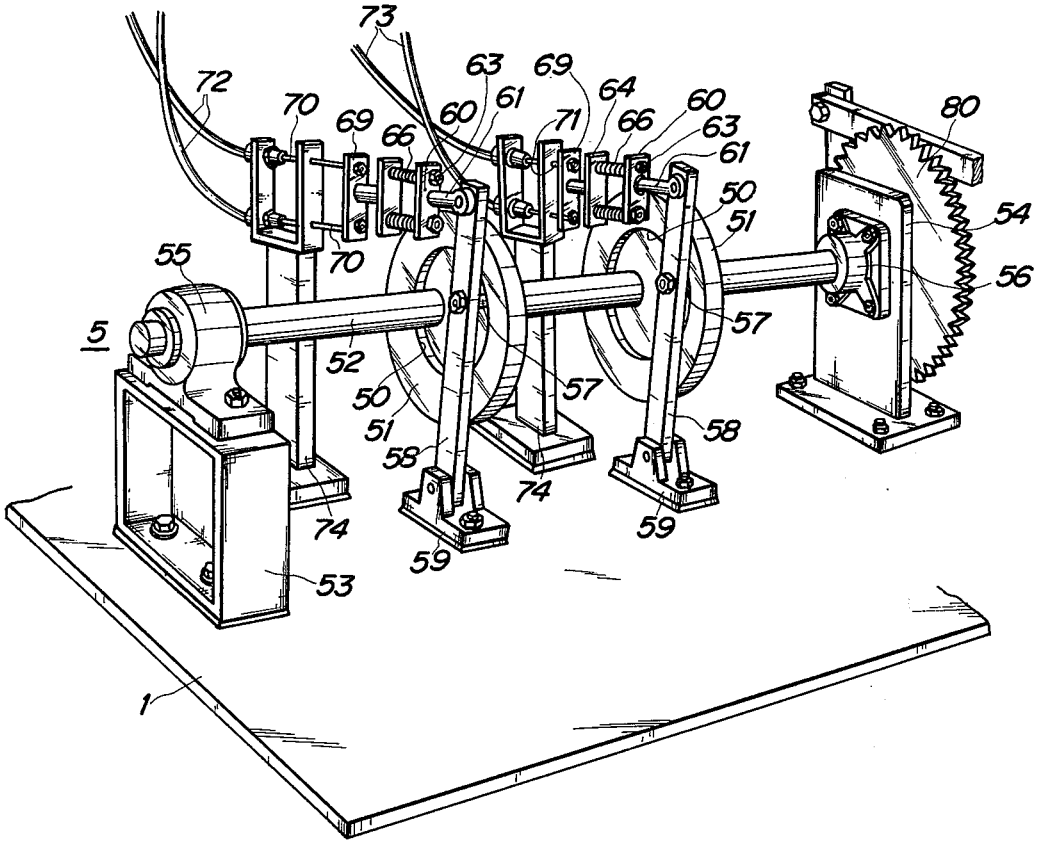
FIG. 4 is a perspective view indicating a relation of steel wires connected to operators and driving force generating cam mechanisms operating these steel wires of this invention.

FIG. 4 illustrates an embodiment construction of cam mechanism 5 in FIG. 1. This cam mechanism 5 contains channel cams 51, 51, on which loop shape channel 50, 50 are engraved on the side of the cams connected operatively to the operator 43, 45. A rotational shaft 52 penetrates into an axis of grooved cam 51, 51 to fix them. Both ends of the rotational shaft 52 are rotatably mounted to brackets 53, 54 fixed on the base plate 1 in bearing 55, 56.

Cam followers 57, 57 which engage to the channel 50, 50 of the grooved cam 51, 51 are provided in a middle portion of a groove sliding arm 58, 58 of which lower edges are pivotally mounted to the bracket 59, 59 set up on the base plate 1. At the upper ends of the groove sliding arm, end of rods 61, 61 respectively secured to the block plates 60, 60 are rotatably connected with pins 62.

Figure 5:
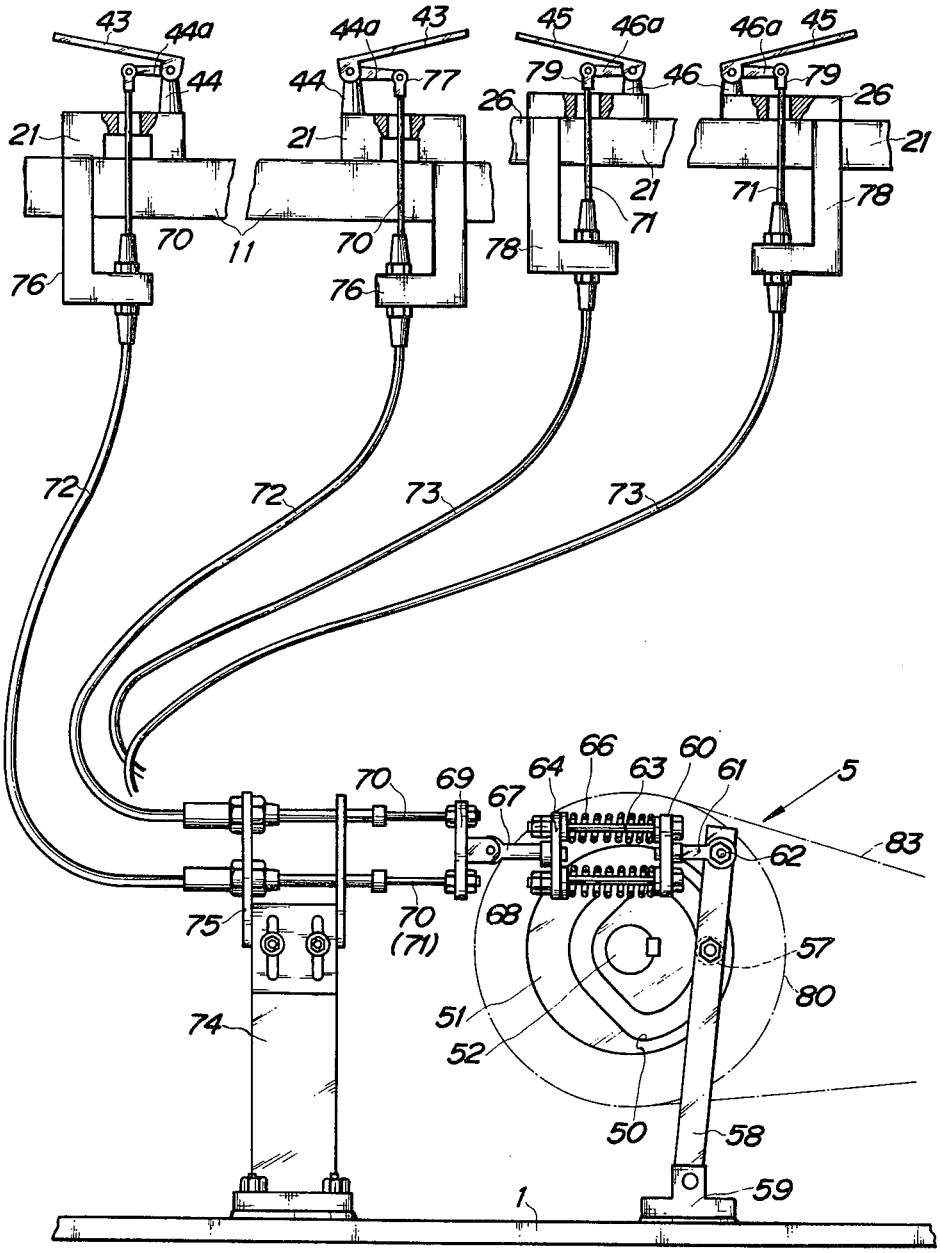
FIG. 5 is side view indicating a connection of the steel wire to the operator or to the cam mechanism.

As illustrated in FIG. 5, one end of two connecting bolts 63, 63 is fixed to the block plates 60, 60 and these connecting bolts 63, 63 are slidably installed with a spring plate 64 to the longitudinal direction of bolts 63, 63 together with the prevention of slipping out of the spring plate 64 from the bolts by nuts 65, 65 engaged at the top of the bolts 63, 63. Between the spring plate 64 and the block plate 60, two coil springs 66, 66 for shock absorption are arranged, whereby these coil springs 66, 66 press outward direction to extent a interval between the spring plate 64 and the block plate 60.

In a middle portion of outside surface of the spring plate 64, one end of connecting rods 67 is secured and the other end of it is rotatably mounted to the wire connecting plate 69 by pin 68 to swing.

Furthermore one end of a pair of steel wire 70, 70 transmitting a driving force to the operator 43, 43 is coupled to both ends of the connecting plate 69 indirectly connected to the groove sliding arm 58. Similarly, one end of a pair of steel wires 71, 71 transmitting a driving force to the operator 45, 45 is coupled to the connecting plate 69 connected to other groove sliding arm 58.

The steel wires 70 and 71 are inserted in hollow and shelled cable 72 and 73 are able to slide in them. One end of cable 72, 72 and 73, 73 are fixed to U-shaped maintanence member 75, 75 which is mounted on the top of bracket 74, 74. The steel wire 70, 70 and 71, 71 which are drawn from the coupling portion of this U-shape maintenance member 75, 75 penetrate this member and connect to the connecting plate as illustrated above.

Shown in FIG. 2 and FIG. 5, another ends of steel wire 70, 70, which are fixed to a lower portion of bracket 76, 76 mounted on the longitudinal member 21, 21 and which are drawn from fixed ends of bracket 76, 76, penetrate the longitudinal member 21 to connect to arm 44*a* provided on each hinge member 44 of the operator 43, 43 through coupler 77. On the other hand, another ends of the cable 73, 73 are fixed to the lower portion of bracket 78, 78 which are mounted to the cross member 26, 26 and another ends of the steel wire 71, 71 penetrate the cross member 26, 26 to connect to arm 46*a* provided on each hinge member 46 of the operator 45, 45 through coupler 79.

With reference to FIG. 1 and FIG. 4, a sprocket wheel 80 is mounted adjacent to bracket 54 and chain 83 is trained between this sprocket wheel 80 and a sprocket wheel 82 provided on output axis of reduction gear 10*b* so that the rotation of the reduction gear 10*b* is transmitted to cam shaft 52. The rotation of an electric motor 10*a* is transmitted to the reduction gear 10*b* through pulley and belt. Also, another sprocket wheel 84 is mounted on the cam shaft 52, and chain 86 is trained between this sprocket wheel 84 and the rotation sprocket wheel 3*d* of cam 3*c* provided adjacent to transmittence feeding device 3*b* of the paper feeding mechanism 3.

With regard to the paste board box forming mechanism, operation is illustrated as follows. With reference to FIG. 1, the cam shaft 52 rotates by actuation of the electric motor 10*a* together with the rotation of the grooved cam 51, 51 and the drive of the transmittent feeding device 3*b* of the paste board feeding mechanism 3. The paste board is set on the rack 20 through feeding roll 3*a,* 3*a* by the transmittent feeding device 3*b.*

Accompanying with the rotation of the grooved cam 51, 51, the groove sliding arm 58, 58 swings in the direction of arrow of FIG. 4 in accordance with the groove shape. The swing is transmitted respectively to the steel wire 70, 70 and 71, 71 through the block plate 60, coil spring 66, spring plate 64, rod 67 and connecting plate 69. Accordingly, the steel wire 70, 70 or 71, 71 are pressed or drawn. Thus driving force transmitted to the steel wire 70, 71 are transmitted to the operator 43 and 45 provided on the longitudinal member 21 and cross member 26. Each operator 43 and 45 causes the hinge member 44 to rotate around a supporting point to assemble the paste board box on the rack 20 by bending each side 7*b,* 7*c* of a paste board.

In above embodiment, two grooved cams by which a pair of steel wire is worked are provided on the cam shaft and four sides of box are bended by the operation of the grooved cams.

Figure 6:
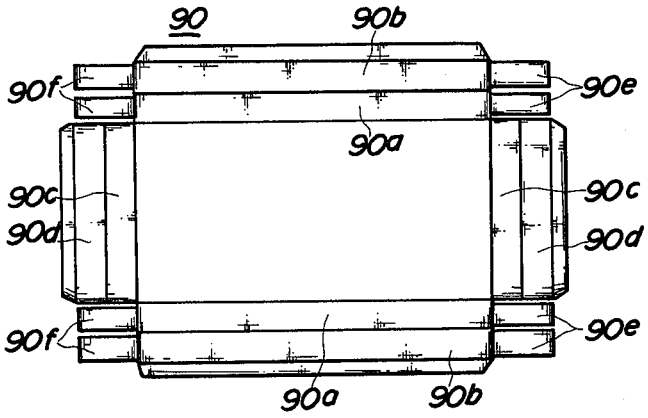
FIG. 6 is a plane view indicating another embodiment of the paste board.

However this invention is not restricted only in this embodiment. For example, in case of the past board 90 having sides 90*a,* 90*a,* 90*b,* 90*b,* - - - 90*f,* 90*f,* as indicated in FIG. 6, the mechanism consists of six grooved cams same as that in FIG. 4 and each grooved cam stands in a line to fix. The groove sliding arm is engaged on each grooved cam and a pair of steel wires having the same construction as that in FIG. 4 are coupled to this groove sliding arm so that the operator used for bending the sides of the paste board box works.

Thus the mechanism transmitting the driving forces to the operators consisting of cam mechanism and steel wire mechanism made easy to connect mechanically the paste board box forming mechanism 4 with a driving device 10. Therefore, it is easy for the expert of this field to mechanically design this machine in addition to low cost.

In this invention, the steel wire is used as a driving force transmitting means, but there are a restriction which this steel wire is able to transmit stress. That is, in case of a driving from with press, if the press added to the steel wire exceeds a constant value within safety permission, the steel wire and the cable cause an extreme meander movement phenomenon to bring about destruction. Because the steel wire is a constructionally long and slender cylinder, the steel wire and the cable are greatly curved when they are used. If tension work is repeated with the force over a permissive tension with high speed, twisted steel wires are severed in a short time.

Figure 7A:
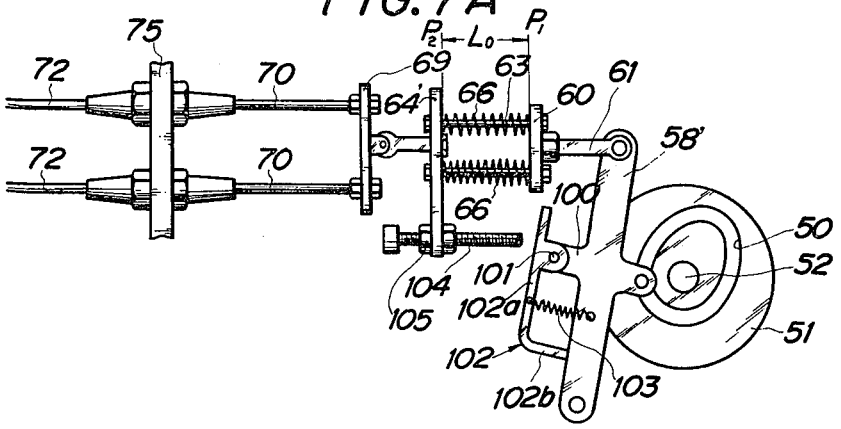
FIG. 7A is a fragmentary side view of a driving force mechanism which is operated prior to the bending of the paste board.
Figure 7B:
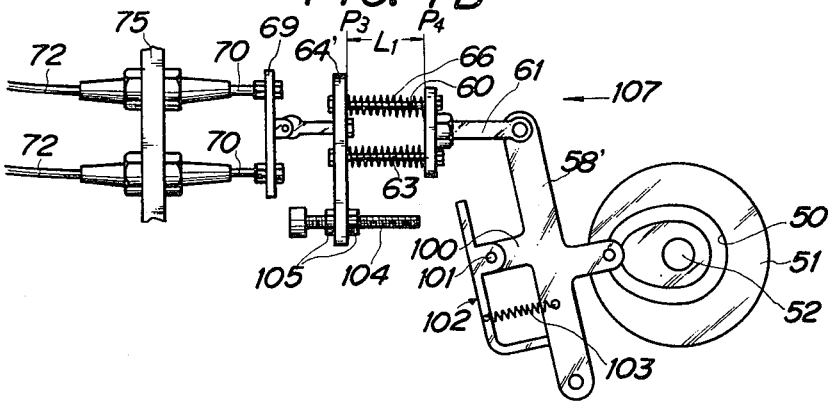
FIG. 7B is a fragmentary side view of a driving force mechanism which is operated during the bending of the paste board.
Figure 7C:
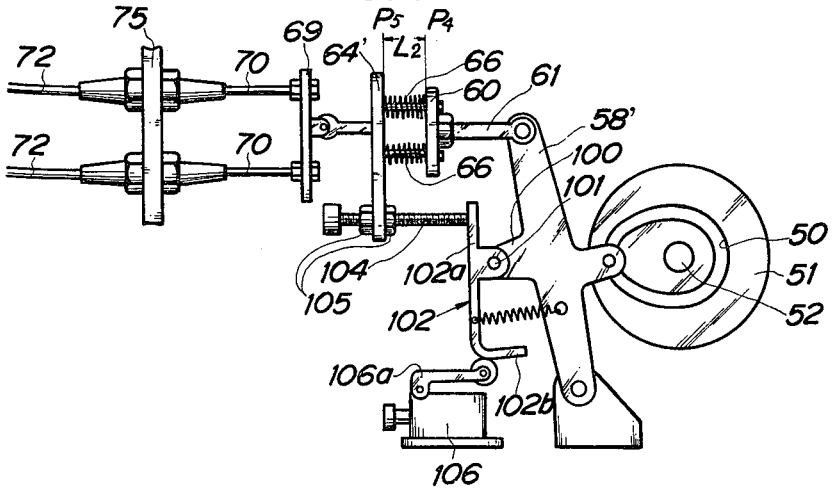
FIG. 7C is a fragmentary side view of an operation condition in case of an accident detection.

Embodiments of this invention in which the above problems are settled are indicated in FIG. 7A to 7C. In this Figure, parts shown with same symbol as in FIG. 5 illustrate same construction as in FIG. 5.

Projecting part 100 is provided in the same side as the side of block plate 60. On this projecting part 100, a vertical member 102*a* of L-shape detector which detects abnormal internal stress is provided rotatably by pin 101.

Between the vertical member 102*a* which is adjacent to horizontal member 102*b* and the groove sliding arm 58', a spring 103 is maintained under tension so that the detector 102 is subject to the counterclockwise force. Then, the horizontal member 102*b* contacts with the groove sliding arm 58' so as to control the rotation over predetermined value of the detector 102 in the counterclockwise direction. Also a lower end of a spring plate 64' is extended downwards. A stress-adjusting-screw 104 penetrates horizontally at this extended portion to be fixed with a nut 105 and contacts to detector 102 in accident. Under the detector 102, a microswitch 106 for detecting an accident is provided.

Operation of accident detecting device constructed as above is as follows. FIG. 7A indicates a position of retreat movement of the groove sliding arm 58', where the block plate 60 is arranged in the position $P_1$ due to retreat movement and the spring plate 64' is arranged in the position $P_2$ without any external force. Therefore, the shock absorbing coil spring 63 positioned between both plate is maintained at length $L_O$ in free state. In this case, position of detector 102 is far from the position of the stress-adjusting-screw 104.

During a bending of the paste board 8, the grooved cam 51 rotates to revolve the groove sliding arm 58' in the direction of arrow 107 so that block plate 60 presses coil spring 63 to transfer itself in the position $P_4$. While the coil spring 63 presses outwardly spring plate 64' to gives pressure by which the operators of the paste board box forming mechanism 4 corresponding to the wire 70 works to bend the paste board. Accompanying to this operation, steel wire 70, 70 are subject to a force pushing back them and corresponding to the resistance against the bending work and this force is transmitted to spring plate 64', so that the coil spring 63 is shortened by this force to result length $L_1$ and the spring plate 64' transfers to the position $P_3$. However, the shortening amount is not enough to make the detector 102 to contact to the stress-adjusting-screw 104.

It happens that the paste board 8 is supplied in piles or a bending work in a position existing no folds due to slipping off of set position on the rack is carried out with the operators and that the resistance resulting from an accidental arrangement prevents the paste board from a normal bending. In this case, the spring plate cannot advance to the position $P_3$ to stop in abnormal position $P_5$. The groove sliding arm 58 is forced to swing by the grooved cam 51 so that the block plate 60 is pressed to the position $P_4$ and the coil spring 63 shortened to the length $L_2$. As a result of this accidental operation, the top of stress-adjusting-screw 104 contacts with the detector 102 to press it, so that the detector 102 rotates in a clockwise direction around the center of the pin 101. By this rotation the horizontal member **102*b* of the detector 102 presses the operational lever 106*a* of the micro switch 106** to make it on. Simultaneously, a warning indicator is lamped or an alarm buzzer trumbles together with an emergent stop of the machine.

By such mechanism, an emergency state of the paste board box forming machine is informed not so as to add the stress exceeding safety limit to the steel wire, and an accident and a destruction of the steel wire or other parts may be prevented in advance.

If the force required to bend the fold of the paste board is 1 Kg to make effective bending, where the length from supporting point to the point of force application is 5 cm to 10 cm if bending point is considered to be a supporting point. This force converted to torque is $1\ Kg \times 0.1\ m = 0.1 Kg{\cdot}m$. If four operators are worked at once, the total force becomes 0.4 $Kg{\cdot}m$, so that even if this force is supplied for the driving force of paste board suppling mechanism, force enough to conduct bending is about 1 h.p., so driving can be made with small motor. As a steel wire transmits the driving force to the operator, total movement inertia moment is extremely small, light and speedily action is possible and higher speed of manufacture is possible.

Figure 8:
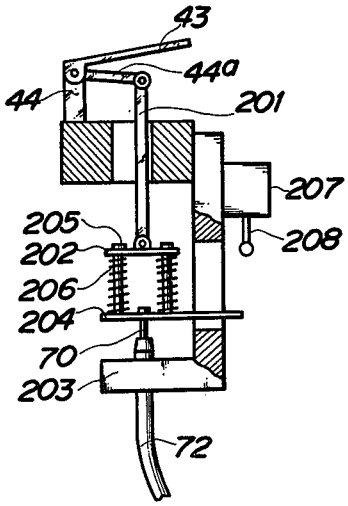
FIG. 8 is a fragmentary side view of another embodiment of an accident detector of this invention.

FIG. 8 indicates another embodiment of trouble detecting device by which a trouble is detected at the side of operator installation. Refering to this FIG. 8, upper end of connecting rod 201 is rotatably connected to the arm **44*a* projectly mounted to the hinge member 44 of operator 43, and the block plate 202 is connected at the lower end of this rod 201. At the end of the steel wire 70 taken out from the fixed end of hollow and shelled cable settled to the bracket 203, spring plate 204 is fixed. Spring plate 204 and block plate 202 are linked with rods 205 to be able to separate or close each other. Between the spring plate 204 and block plate 202, coil spring 201 for shock absorbance is coiled around the rod 205. Also, operation lever 208 of micro switch 207 for a trouble detection faces toward the end of the spring plate 204** not to contact at the normal time.

If an abnormal bending is conducted, coil spring 206 is extremely pressed and spring plate 204 contacts with operational lever 208 of the micro switch, whereby micro switch is pressed to be ON. In this case, same effect as in FIG. 7 A, B, and C is clearly obtained.

I claim:

1. An automatic paste board box forming machine comprising a paste board box forming mechanism for bending and assembling a paste board, said paste board forming mechanism including a member for paste board box assembling, a paste board supplying mechanism for supplying paste boards to said forming mechanism and driving means for driving both mechanisms, wherein these mechanisms include:

a driving force generating mechanism for generating a driving force necessary for bending and assembling the paste board in said paste board box forming mechanism, a hollow cable; a steel wire slidably inserted into said hollow cable, one end of said steel wire being connected to said driving force generating mechanism; the other end of said steel wire being connected to the paste board box assembling member, said paste board forming mechanism including an alarm;

a shock absorbing member interconnected between said one end of said steel wire and said driving force generating mechanism, said shock absorber being compressible to a predetermined length; and means detecting the compressed length of said shock absorbing member; for actuating said alarm upon said shock absorber being compressed to said predetermined length.

2. An automatic paste board box forming machine as claimed in claim 1 wherein said driving force generating mechansim comprises:

a cam shaft; a cam rotatably disposed on said cam shaft, a groove being formed in said cam, a sliding arm engaging said groove and being reciprocally movable in dependence of the movement of the cam, said sliding arm being connected to said steel wire through said shock absorbing member.

3. An automatic paste board box forming machine as claimed in claim 1 wherein said shock absorbing member comprises a coil spring;

a block plate connected to said driving force generating mechanism and a spring plate connected to said steel wire, said coil spring being inserted between said block and spring plates.

4. An automatic paste board box forming machine as claimed in claim 1 wherein the detection means include a microswitch acutable for stopping the operation of said machine upon activation of the detecting means.

5. An automatic paste board box forming machine comprising:

paste board box forming means for bending side panels of a paste board to form a paste board box;

paste board supplying means for supplying a plurality of paste boards to said paste board box forming means;

driving means for driving said paste board forming and supplying means;

a shaft disposed in said paste board box and rotatable by said driving means;

a plurality of cams, each of said cams being provided with a continuous groove and being attached to said shaft;

a plurality of arms, each of said arms having upper and lower ends, and a plurality of cam followers provided at the center portions of said arms, said cam followers being engaged with said continuous grooves, respectively;

a plurality of first brackets, the lower ends of said arms being pivotally attached to said brackets;

a plurality of second brackets formed with openings, and a plurality of cables exiting through the second bracket openings, said second brackets being disposed in the vicinity of said cams;

a plurality of third brackets attached to said paste board forming means;

a plurality of steel wires, each of said steel wires having first and second ends; and a plurality of bending members, the first steel wire ends being connected to said bending members, respectively, the second steel wire ends extending through said cables, and shock absorber means operatively interposed between said bending members and the upper ends of said arms.

6. An automatic paste board box forming machine according to claim 5 wherein said shock absorber means are interconnected between the upper ends of said arms and the second steel wire ends.

7. An automatic paste board forming machine according to claim 5 wherein said shock absorber means are interconnected between said bending members and the first steel wire ends.

8. An automatic paste board box forming machine according to claim 5 comprising:

a plurality of longitudinal members, said plurality of third brackets being mounted on said longitudinal members respectively, a plurality of hinge members disposed on said longitudinal members respectively, said bending members being hingeably attached to said hinge members.

* * * * *